US006961038B2

(12) United States Patent
Yoshinaga et al.

(10) Patent No.: US 6,961,038 B2
(45) Date of Patent: Nov. 1, 2005

(54) COLOR LIQUID CRYSTAL DISPLAY DEVICE

(75) Inventors: Hideki Yoshinaga, Kanagawa (JP); Hideo Mori, Kanagawa (JP); Seishi Miura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 09/994,746

(22) Filed: Nov. 28, 2001

(65) Prior Publication Data

US 2002/0063670 A1 May 30, 2002

(30) Foreign Application Priority Data

Nov. 30, 2000 (JP) ..... 2000/365504
Nov. 5, 2001 (JP) ..... 2001/339332

(51) Int. Cl.[7] ..... G09G 3/36
(52) U.S. Cl. ..... 345/88; 345/84; 345/87; 345/82; 345/83; 345/102
(58) Field of Search ..... 345/88–89, 82–84, 345/55, 102, 690, 87; 348/744

(56) References Cited

U.S. PATENT DOCUMENTS 4,525,729 A * 6/1985 Agulnek et al. ..... 347/237
5,369,432 A * 11/1994 Kennedy ..... 348/181
6,115,016 A * 9/2000 Yoshihara et al. ..... 345/88
6,188,379 B1 * 2/2001 Kaneko ..... 345/102
6,243,067 B1 * 6/2001 Noguchi et al. ..... 345/102
6,326,981 B1 12/2001 Mori et al. ..... 345/695
6,392,717 B1 * 5/2002 Kunzman ..... 348/744
6,421,037 B1 * 7/2002 Chen ..... 345/92
6,597,348 B1 * 7/2003 Yamazaki et al. ..... 345/175

* cited by examiner

*Primary Examiner*—Vijay Shankar
*Assistant Examiner*—Leonid Shapiro
(74) *Attorney, Agent, or Firm*—Fitzpatrick, Cella, Harper & Scinto

(57) ABSTRACT

A color liquid crystal display device includes at least a liquid crystal display part, and light sources for irradiating the liquid crystal display part with lights of three primary colors, respectively, and performs display of one frame by respective fields of three primary colors and a white field displayed with a mixture of the three primary colors in the liquid crystal display part. The device further includes a circuit for comparing brightness levels of inputted three primary color signals for one frame with each other to define a maximum value thereof as a brightness level of a white signal for one frame; a circuit for setting a proportion of the brightness level of the white signal to be displayed in the white field; and a light source driving part for driving the light sources of the three primary colors so that the white field emits light depending on the brightness level of the white signal and the proportion.

4 Claims, 10 Drawing Sheets

COLOR LIQUID CRYSTAL DISPLAY DEVICE

BACKGROUND OF THE INVENTION

1. Field of the Invention

The present invention relates to a liquid crystal display device for performing color display that is used in a color television, a personal computer or the like, and to particularly a liquid crystal display device for providing three primary color display by time-sharing, and providing full color display by mixing the three primary colors without using any color filter.

2. Related Background Art

In recent years, color liquid crystal displays have grown in demand due to advancement of personal computers.

In liquid crystal display devices that are currently on the market, color filters for three primary colors of red (R), green (G) and blue(B) are placed in positions corresponding to pixels, backlights are placed on the back face, and white light is applied to obtain color images.

On the other hand, a color liquid crystal panel of field sequential mode that has a liquid crystal panel of monochrome display and backlights each capable of illuminating lights of three primary colors to perform color display by time-sharing without having any color filters has been proposed.

First, a color liquid crystal display device of field sequential mode using RGB three-color light sources will be described as a conventional example 1.

FIG. 11 is a block diagram showing a configuration of the above-described color liquid crystal display device. In FIG. 11, reference numerals 11 to 13 denote AID (analog/digital) conversion circuits, reference numeral 20 denotes a P/S (parallel/serial) conversion circuit, reference numeral 21 denotes a memory, reference numeral 22 denotes a liquid crystal display part, and reference numeral 23 denotes a light source unit.

In the liquid crystal display device of FIG. 11, signals of three primary colors of R (red), G (green) and B (blue) included in an inputted color image signal are inputted to their input terminals, and digital conversion processing is carried out in the AD conversion circuits 11 to 13. R, G and B digital signals outputted from the A/D conversion circuits 11 to 13 and a synchronous signal $V_{sync}$ are supplied to the P/S (parallel/serial) conversion circuit 20. The P/S conversion circuit 20 comprises a memory 21, and inputted R, G and B digital signals are serially outputted at a threefold speed from the P/S conversion circuit 20. The threefold-speed digital signals are supplied to the liquid crystal display part, and are subjected to analog conversion in a drive IC (not shown). Also, similarly, synchronous signals $F_{sync}$ are generated based on the synchronous signal $V_{sync}$ supplied to the P/S conversion circuit 20, and are synchronously separated from each other and supplied to the liquid display part 22 and the light source unit 23, respectively.

In the liquid crystal display part 22, the supplied threefold-speed digital signals are subjected to analog conversion to display an image, and in the light source unit 23, light source controlling signals of respective colors are generated based on the supplied synchronous signal $F_{sync}$, and R, G and B light sources are successively lit based on timing of the light source controlling signals, as shown in FIG. 15.

In FIG. 15, reference characters $BL_R$, $BL_G$ and $BL_B$ denote timings of lighting of R, G and B light sources, respectively, reference character 1F denotes one frame, reference character if denotes one field, reference character LC denotes the light transmittance (maximum transmittance is 100%) of the pixel in 100% gray level display, and reference character T denotes brightness of light caught by observer's eyes.

Furthermore, in FIG. 15, a state of transient transmission due to delay of speed of response by the liquid display part and delay at the time of on/off of the light sources of three primary colors is not considered.

As shown in FIG. 15, the R light source is lit for the field in which the R image is displayed on the liquid crystal panel 22, the G light source is lit for the field in which the G image is displayed thereon, and the B light source is lit for the field in which the B image is displayed thereon. In this way, by successively displaying the R, G and B images, full color images can be displayed using light persistence in the eye.

In a liquid crystal display device that performs color display in plane sequential mode, no problems arise when a static image is displayed, but, for example, in display of dynamic images in which a white image (image represented with two or more of R, G and B colors) moves on the screen, a "color sequential artifact" (hereinafter abbreviated as "CSA"), in which coloring occurs before and after movement of the dynamic image due to time difference among R, G and B fields, occurs. Also, conversely, the color sequential artifact (CSA) similarly occurs when the line of an observer's sight is shifted. This situation is schematically shown in FIGS. 12A and 12B. In FIGS. 12A and 12B, reference numeral 121 denotes the line of an observer's sight, reference characters n and n+1 denote any sequential frames, reference character ΔX denotes the amount of movement of the dynamic image from the n frame to the n+1 frame, and reference character t denotes time.

FIG. 12A shows the color sequential artifact (CSA) occurring when the observer shifts the line of sight in the left to right direction over the drawing, in the case where a white display (W) image obtained by mixing R, G and B is displayed at the time of the displayed background color of black (B). As shown by the line of sight of FIG. 12A, assuming that the line of sight of the observer making an observation with the G field at the center is shifted, the position on the retina relative to the line 121 indicated by the line of the observer's sight is varied for each of R and B fields. Therefore, the position of light remaining on the retina is varied for each of R, G and B fields, and thus as shown in FIG. 12B, coloring of cyan (C) and B occurs on the left side of the W image, and coloring of yellow (Y) and R occurs on the right side of the image. Also, a similar phenomenon occurs when a person looking at something outside the screen rapidly shifts the line of sight to the screen. Also, such a phenomenon is typically observed when a highly bright and colorless image is moved in a dark background image, even when the line of sight is fixed.

For a method of preventing the color sequential artifact, there is a method in which the field frequency is increased, in the first place. However, for example, if horizontal and vertical scan frequencies are increased by two times compared to the conventional frequencies (the field frequency is increased to a sixfold-speed), for example, power consumption is increased due to enhancement of the speed of data transfer, the speed of response by the liquid crystal is reduced to provide only poor display, and so on, thus causing other problems to arise.

A second method of the conventional technology is a method in which four fields including three fields of primary R, G and B colors and a white field (hereinafter referred to as "W field") are successively driven in order to alleviate the above problems. FIG. 13 is a block diagram showing the configuration of a device for performing this method. In FIG. 13, reference numeral 14 denotes a minimum value detection circuit, reference numerals 17 to 19 denote subtraction processing circuits, and members identical to those in FIG. 11 are denoted by the same reference characters.

In the device shown in FIG. 13, as in the case of the device of FIG. 11, R, G and B signals included in inputted color image signals are inputted in their individual input terminals, and are subjected digital conversion in A/D conversion circuits 11 to 13. The signals of R, G and B colors and a synchronous signal $V_{sync}$ outputted from the A/D conversion circuits 11 to 13 are supplied to the minimum value detection circuit 14, the minimum value detection circuit 14 compares the inputted R, G and B digital signals, and supplies the minimum value thereof to the P/S conversion circuit 20 as the W signal. At the same time, the minimum value detection circuit 14 supplies the value to the R, G and B subtraction processing circuits 17 to 19. Also, the minimum value detection circuit 14 supplies R, G and B digital signals to the R, G and B subtraction processing circuits 17 to 19, respectively.

The R, G and B subtraction processing circuits 17 to 19 carry out processing of subtracting the W signal (the minimum value of R, G and B digital signals) displayed in the white field from the inputted R, G and B color signals, and R', G', B' and W color signals subjected to subtraction processing are supplied to the P/S conversion circuit 20, and are stored in the frame memory 21. In addition, the synchronous signal $V_{sync}$ outputted from the minimum value detection circuit 14 is also supplied to the P/S conversion circuit 20.

The parallel R', G', B' and W color signals inputted in the P/S conversion circuit 20 are serially outputted via the memory 21. In other words, a fourfold-speed digital signal obtained by subjecting the R'/G'/B'/W color signals to time-sharing is supplied to the liquid crystal display part 22 of monochrome display. Also, signals $F_{sync}$ generated based on the signal $V_{sync}$ inputted in the P/S conversion circuit 20 are synchronously separated from each other and supplied to the liquid crystal panel 22 and the light source unit 23, respectively.

In the liquid crystal display part 22, the supplied fourfold-speed digital signal is subjected to analog conversion to display a monochrome image. On the other hand, in the light source unit 23, light source controlling signals of respective primary colors are generated based on the supplied synchronous signal $F_{sync}$ and light sources of R, G, B and W (the white is obtained by simultaneous lighting of R, G and B light sources) are successively lit based on the timing of the light source controlling signals, as shown in FIG. 16. Furthermore, reference characters in FIG. 16 are same as those in FIG. 15.

In the liquid crystal display part 22, the field where the R image is displayed is irradiated with light from the R light source, the field where the G image is displayed is irradiated with light from the G light source, the field where the B image is displayed is irradiated with light from the B light source. In addition, the field where the W image is displayed is irradiated with lights from the R, G and B light sources at the same time to irradiate the liquid crystal display part 22 with white light. In this way, by successively displaying images of R, G, B and W, full color images are displayed using the light remaining property of the retina.

In the meantime, for the liquid crystal panel, the R light source is lit during display of the R image, but a part of the R signal outputted to the liquid crystal panel is used as a white signal, and therefore brightness for the R color is reduced in proportion to the amount of the part used, and the R color becomes less noticeable. The same is applied to G and B, and as a result, the CSA is less noticeable compared to the conventional example 1.

As shown in FIGS. 14A and 14B, by displaying the W image, the color sequential artifact can be curbed even when the line of sight is shifted and when a quick-motion image is displayed.

However, the method of the conventional example 2 including the W field has an increased power consumption of the light source and an inferior efficiency of light usage, in comparison with the display method of the conventional example 1.

In the RGB system, when the white image is displayed by mixing the three primary colors of light sources, a signal having the maximum level of transmittance in each field of R, G and B should be given to the liquid crystal display part, while each of R, G and B light sources should be lit for the time period corresponding to ⅓ of one frame as shown in FIG. 15. As a result, for the white image, the observer observes brightness corresponding to ⅓ of one frame.

Similarly, when the white image is displayed with a RGBW system constituted by four fields of R, G and B fields plus a W field, brightness signals inputted in the liquid crystal display part are all used as display information of the W field, and therefore their transmittance is 0% in each of R, G and B fields and the white image is displayed with the brightness signal having the maximum transmittance only in the W field. On the other hand, for the light source, the R light source is lit twice covering the R field and W field, and similarly other light sources have their lighting time periods increased by two times. Thus, as shown in FIG. 16, brightness corresponding to each of R, G and B light sources being lit for the time period corresponding to ¼ of one frame is observed.

Therefore, if brightness levels of R, G and B light sources in FIGS. 15 and 16 are the same, the brightness for the RGBW system is ¾ of the brightness for the RGB system when the brightness for the RGB system and the brightness for the RGBW system are compared with each other. Also, for the time period over which each light source is lit in each frame, each of R, C and B light sources is lit for the time period corresponding to ⅓ of one frame for the RGB system, while each of the light sources is lit for the time period corresponding to ½ of one frame for the RGBW system, and therefore power consumption of the light source for the RGBW system is 1.5 times larger than that for the RGB system. As a result, efficiency of light usage for the RGBW system is reduced by ½ in comparison with that for the RGB system.

The object of the present invention is to solve the above problems, and restrain the color sequential artifact and reduce power consumption of light sources in a liquid crystal display device providing color display in field sequential mode.

SUMMARY OF THE INVENTION

An object of the present invention is to provide a color liquid crystal display device comprising a liquid crystal display part, and light sources for irradiating the liquid crystal display part with lights of three primary colors, respectively, the device performing display of one frame by respective fields of three primary colors and a white field displayed with a mixture of the three primary colors in the liquid crystal display part, wherein the device further comprises:

means for comparing brightness levels of inputted three primary color signals for one frame with each other to define the maximum value thereof as the brightness level of a white signal for one frame;

means for setting the proportion of the brightness level of the white signal to be displayed in the white field; and a light source driving part for driving the light sources of the three primary colors so that the white field emits light depending on the brightness level of the white signal and the proportion.

Also, another object of the invention is to provide a color liquid crystal display device comprising a liquid crystal display part, and light sources for irradiating the liquid crystal display part with lights of three primary colors, respectively, the device performing display of one frame by respective fields of the three primary colors and a white field displayed with a mixture of the three primary colors in the liquid crystal display part, wherein the device further comprises a light source driving part for driving the light sources of three primary colors, and wherein when brightness levels of inputted three primary color signals for one frame are compared with each other to define the maximum value thereof as the brightness level of a white signal for one frame, the light source driving part is driven depending on the brightness level of the white signal, and the proportion of the brightness level of the white signal to be displayed with the white field.

The present invention is particularly intended to improve the above-described conventional examples, and to reduce power consumption of light sources while inhibiting the color sequential artifact at the time of performing display by four fields of R, G, B and W.

One of embodiments of the present invention performs the following processing for brightness signals in R, G and B color image signals inputted in one frame.

1) First, brightness levels of three primary color (R, G and B) signals are compared with each other for each pixel unit to determine the minimum value Wmin thereof. It is further compared with all pixel information in one frame to determine the maximum value Wmax of the brightness level of the white signal in one frame.

2) The above-described Wmax is defined as the maximum value of the brightness level of the white signal, and is used as a brightness signal of the white image in the W field, and in the W field, each of R, G and B light sources is lit in such an emission intensity that this brightness level is obtained.

Therefore, as compared with the conventional example 2, each of R, G and B light sources is lit at the maximum intensity in the W field, for example in the case of dark images, by reducing the emission intensity in the W field, power consumption of light sources in the W field can be reduced, and thus power consumption of the device can be reduced.

The second embodiment of the present invention performs the following processing.

3) The proportion S of the brightness level of the white signal to be displayed in the W field is set, as will be described later, for the maximum brightness Wmax in one frame unit of the above-described Wmin signal, and the brightness level having a magnitude of Wmax multiplied by this proportion S is defined as a maximum display brightness in the W field. In accordance therewith, the emission intensity of the light source for emitting light is decreased to further reduce power consumption. This proportion S can be automatically set corresponding to the image, or can be freely set by the observer using a switch or the like.

At this time, for display information given to the liquid crystal display part, display information of white color used in the W field uses a value given by multiplying the proportion of the Wmin signal of each pixel for the above-described brightness signal of Wmax by the inverse of the above-described proportion, namely a value given by Wmin/(Wmax×S). On the other hand, in the R, G and B fields, R', G' and B' display signals with values obtained by subtracting the brightness level displayed in the W field from the brightness level of the original R, G and B signals are displayed.

In addition, the third embodiment of the present invention performs the following processing with respect to the setting of the above-described proportion S.

4) The above-described proportion S of the brightness level of the white signal displayed in the W field is set to a large value when quick motion is displayed in an image of high brightness, which can cause a color sequential artifact, and conversely, the above-described proportion is set to a small value when a static image is displayed.

5) In addition, when the above-described proportion S equals zero percent (0%), display is not performed in the W field, and thus the W field itself is eliminated to drive light sources only in the three fields of R, G and B, thereby further reducing power consumption.

DETAILED DESCRIPTION OF THE PREFERRED EMBODIMENTS

A liquid crystal display device of the present invention will be described in detail below by using the drawings.

The liquid crystal display device comprises a liquid crystal display part, light sources having three primary colors and generating a white color by mixture thereof, namely R, G and B light sources, specified means for converting an inputted color image signal into a signal for driving a liquid crystal panel, and means for controlling the brightness of the light sources. The liquid crystal display part for use in the present invention is a monochrome display panel having no color filters, and may be any liquid crystal element of high speed response such as a conventional twisted nematic liquid crystal element and a ferroelectric liquid crystal. Also, it is not limited to the liquid crystal element, and may be a light-receiving type and projection type display element.

Figure 1:
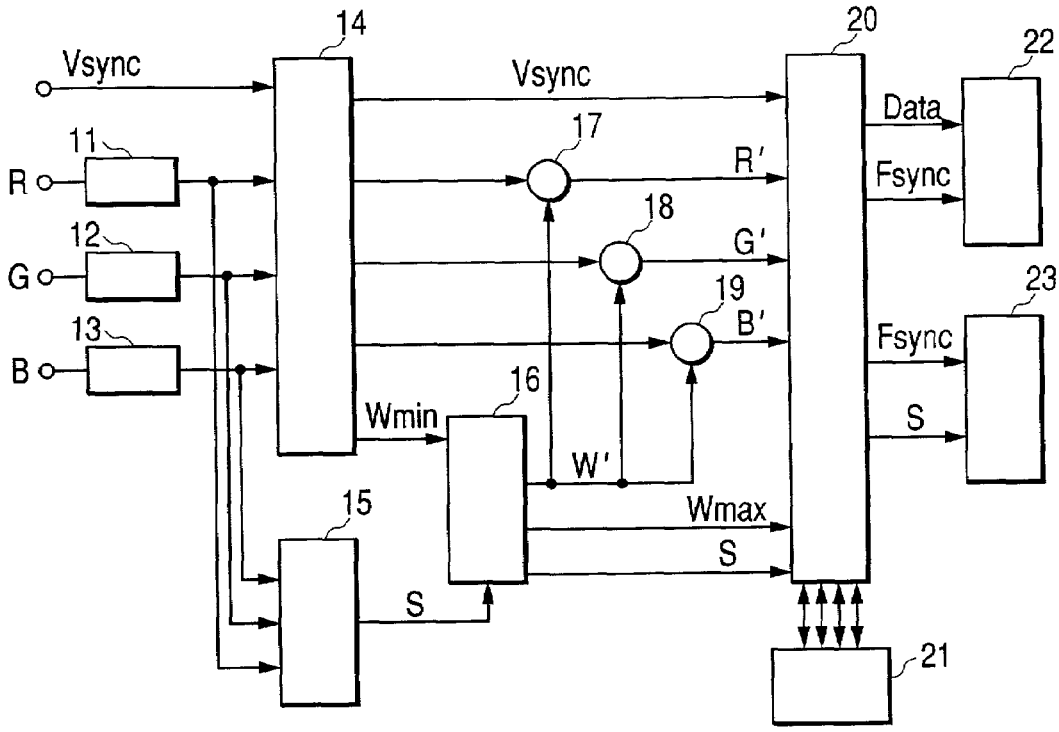
FIG. 1 is a block diagram showing the constitution of one embodiment of a color liquid crystal display device of the present invention.

A block diagram of a preferred embodiment of the liquid crystal display device of the present invention is shown in FIG. 1.

R, G and B signals included in color image signals inputted in the device are inputted in analog-digital (A/D) conversion circuits 11 to 13 for inputted signals from their individual input terminals, and are subjected to digital conversion. R, G and B color signals outputted from the A/D conversion circuits 11 to 13 are inputted in a minimum value detection circuit 14, the brightness signals of R, G and B colors are compared for one pixel to detect a minimum value Wmin in the first place, and the value is outputted to a proportion level modulation circuit 16. In addition, the value of Wmin is compared over an entire frame image by a built-in comparison circuit to determine a maximum value Wmax of brightness levels of the white signal on the frame.

Also, the magnitudes of display signals for respective display fields of R, G and B of respective pixels are stored in a frame memory 21 through a P/S conversion circuit 20, as values R', G' and B' obtained by subtracting the intensities corresponding to the brightness level displayed in the W field subtracted from the original signal intensities of R, G and B in subtraction processing circuits 17 to 19.

Also, R, G and B input signals are supplied at a time to a dynamic image/brightness detection circuit 15 including therein a motion detection circuit to detect whether there is a motion of image relative to the image of the previous frame, or detect a change of the maximum brightness, thereby determining the proportion S of the brightness level of the white signal of the above-described Wmax to be displayed in the W field.

On the other hand, the maximum brightness Wmax of the white signal in one frame outputted from the minimum value detection circuit 14 is sent through the proportion level conversion circuit 16 to the P/S conversion circuit 20, and is multiplied by the above-described proportion S, the value of (Wmax×S) is stored in the frame memory 21. Because this value becomes the maximum value of the brightness level of white color in the W field, the emission intensity of each of the R, G and B light sources is determined so that this value can be obtained.

Also, the white display signal corresponding to the above-described W field given to the liquid crystal display part for each pixel is controlled while the transmittance of the liquid crystal display part is changed so that the observer can see the Wmin that is the original white brightness of the pixel. In the above-described case, if the transmittance of the liquid crystal panel in the W field equals Wmin/(Wmax×S), display corresponding to the original Wmin can be obtained.

Furthermore, because the brightness signal for television has each of R, G and B digital signals subjected to gamma (γ) correction, it is more preferable that the proportion of W digital signal to be displayed is set after γ is made to equal 0, but this is not described herein because this processing is complicated.

Next, the setting of the proportion S will now be described.

In the dynamic image/brightness detection circuit 15, by detecting whether or not each change of the inputted R, G and B color signals on the memory inputted by the dynamic image detection circuit exists, for example, detection brightness is performed only when a motion relative to the previous frame is detected. The brightness detection circuit detects the brightness level of image data (not static image) not related to the previous frame in the dynamic image detection circuit, in addition to the brightness level of the entire frame.

Specifically, when an image of high brightness and achromatic color moves, for example, an image such that a white window moves in a black background is most likely to cause the color sequential artifact.

Therefore, the proportion S is set such that the brightness level of the entire frame detected by the brightness detection circuit is compared with the brightness level of dynamic image data detected by the dynamic image detection circuit, and the proportion S is increased with the difference between the both brightness levels becoming large.

For example, the proportion S is set at 100% when the above-described difference in brightness is large, a middle value is set depending on the difference in brightness, and inversely the proportion S is set at 0% when no dynamic image is detected as in the case of a static image.

Thus, the proportion S is set such that the sampling rate increases with the difference between the brightness level of the entire frame detected by the brightness detection circuit and the brightness level of dynamic image data detected by the dynamic image detection circuit, and a signal corresponding to the proportion S is outputted to the proportion level modulation circuit 16.

In the proportion level modulation circuit 16, the W signal inputted from the minimum value detection circuit 14 is subjected to level correction based on the proportion S inputted in a similar way. Then, a level amount obtained by subtracting the brightness level W' from each of the R, G and B color signals in the subtraction processing circuits 17 to 19 is supplied to the P/S conversion circuit 20 as R', G' and B' digital display signals.

R', G', B' and W color signals supplied to the P/S conversion circuit 20 are supplied via the frame memory 21 to the liquid crystal display part 22. At this time, when the above-described proportion is not 0%, digital signals having the four colors of R', G', B' and W are preferably outputted in a fourfold-speed, and when the above-described proportion is 0%, digital signals having three colors of R', G' and B' are preferably outputted in a threefold-speed.

Also, the synchronous signal $V_{sync}$ causes synchronous signals $F_{sync}$ corresponding to the above-described fourfold- or threefold-speed to be outputted.

In addition, the synchronous signals $F_{sync}$ and a proportion level signal are supplied from the P/S conversion circuit 20 to a light source unit 23.

In the liquid crystal display part 22, the inputted fourfold or threefold digital signal is subjected to analog conversion by a driver IC, and a monochrome image is displayed based on the timing of the synchronous signal $F_{sync}$. Images divided into R, G, B and W fields, or images divided into R, G and B fields when the above-described proportion S is 0% are successively displayed within one frame.

In the light source unit 23, light source controlling signals of respective colors are generated based on the inputted synchronous signal $F_{sync}$, and R, G and B light sources are lit based on the timings of the light source controlling signals. Relation between the lighting timing of respective R, G and B light sources and the light transmittance of the liquid crystal panel in this device will be illustrated below using FIGS. 2 to 8.

In FIGS. 2 to 8, reference characters $BL_R$, $BL_G$ and $BL_B$ denote the lighting timings of respective R, G and B light sources and the brightness thereof (as 100% at the maximum) respectively, and reference character LC denotes the light transmittance of any pixel of the liquid crystal display part as 100% at the maximum. Also, reference characters 1F and 1f denote one frame and one field, respectively.

Figure 2:
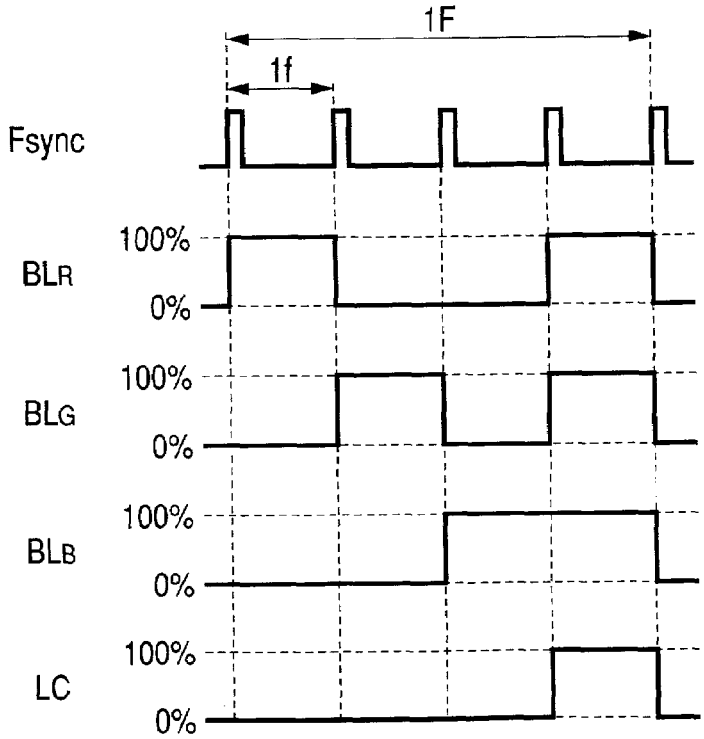
FIG. 2 is a timing chart showing the lighting timing and brightness of each of R, G and B light sources and the corresponding light transmittance of a liquid crystal display part when the minimum value of inputted R/G/B brightness signals is 100%, and the proportion of a white signal displayed in the W field is 100%.

FIG. 2 is a timing chart when 100% transmittance of the brightest state is given in the case where the brightest state is defined as 100% and the darkest state is defined as 0%. The proportion S is set at 100%. First, on the light source side, light sources of R, G and B are individually lit in time-sharing in the R, G and B fields, and R, G and B light sources are lit at a time in the same emission brightness in the W field. Therefore, the time period over which each light source is lit corresponds to ½ of one frame. Thus, power consumption of each light source is reduced to ½ of the power consumption at the maximum lighting where an entire frame is illuminated. Also, on the liquid crystal display part side, the magnitude of the white signal component included in each of R, G and B signal information is Wmin, and this is all used as the white signal in the W field. Therefore, since color information of R, G and B is all displayed in the W field, the display signal of the liquid crystal display part corresponding to each of the R, G and B fields is zero, and display information of zero percent (0%) is outputted to the liquid crystal panel, and the light transmittance of the liquid crystal display part in the R, G and B fields is 0%.

Figure 3:
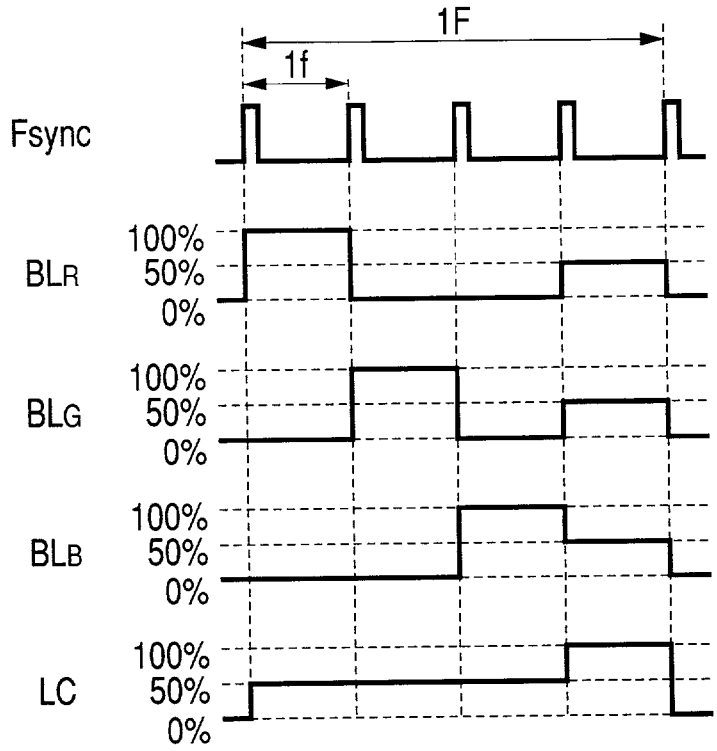
FIG. 3 is a timing chart when the minimum value of inputted R, G and B brightness signals is 100% and the above-described proportion is 50%.

FIG. 3 is a timing chart when the above-described proportion S is 50% in a gradation level display frame similar to that in FIG. 2. Lighting timings of the R, G and B light sources are the same as those in FIG. 2, but the emission intensity of each of the R, G and B light sources in the W field is set so that the maximum brightness 100% is multiplied by the proportion 50% to obtain white display of 50% brightness level. Also, display information to the liquid crystal panel in the W field represents 100% gradation level×the above-described proportion 50%×the inverse of the above-described proportion 50%=100%, and as a result, display information is given so that 50% brightness is provided. On the other hand, for display information given to the liquid crystal display part in the R, G and B fields, since 50% of the white color signal is displayed in the W field, a signal with the brightness level corresponding to the 50% gradation level subtracted from each of the original R, G and B color signals is given. Therefore, display information of the liquid crystal display part represents 50%, and by irradiation of light from each of R, G and B light sources lit in the emission intensity of 100%, a 50% gradation level is displayed. in terms of one frame unit, the same amount of light as that of FIG. 2 is transmitted. The time period over which each of the R, G and B light sources is lit is ½ of one frame and is not different from that of FIG. 2, but since each color light source is lit in the emission intensity of 50% in the W field, power consumption is ⅜ of the power consumption at the time of maximum lighting when respective color light sources are lit in all the fields, and is ¾ of the power consumption when the above-described proportion is 100%.

In this way, by using the proportion S of the white color brightness level displayed in the W field, the emission intensity in the W field can be reduced, and consequently power consumption of light sources can be reduced.

Figure 4:
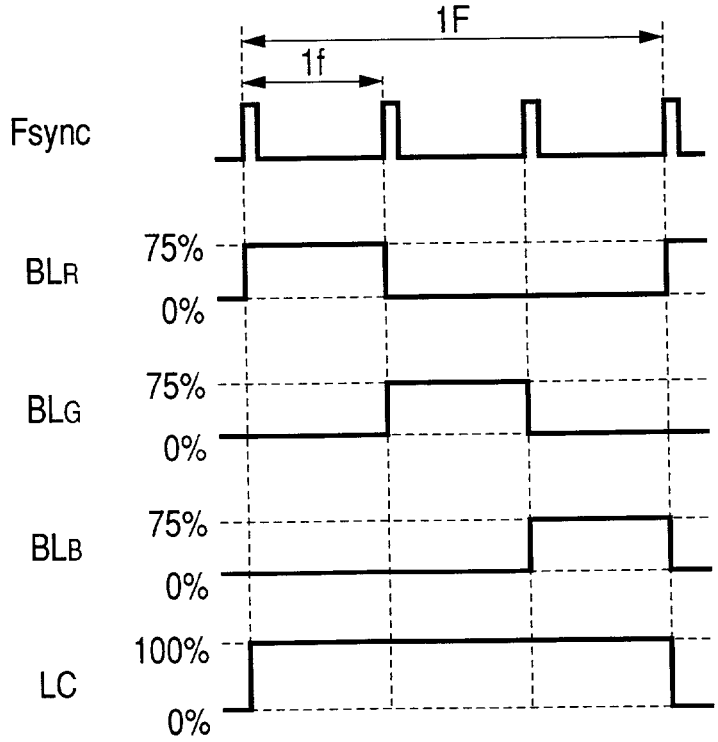
FIG. 4 is a timing chart when the minimum value of inputted R, G and B brightness signals is 100% and the above-described proportion is 0%.

FIG. 4 shows an example in which the above-described proportion is set to 0% when a white color signal in the brightest state is inputted, namely, the image information of the minimum value Wmin of R, G and B signals equaling to 100%. Since the W signal is not displayed in the W field, display information given to the liquid crystal display part in R, G and B fields is displayed with original 100% gradation level signals without being subjected to subtraction processing. Therefore, display information given to the liquid crystal display part becomes 100%. Also, when the above-described proportion equals 0%, the white color signal given to the liquid crystal display part in the W field is 0%, and the emission intensity of each of the R, G and B fields is also 0% (that is, no light is emitted), and thus the W field itself is omitted and the R, G and B system in which one frame is displayed only with three fields of R, G and B colors is used. Thereby, the lighting time period of each of R, G and B light sources corresponds to ⅓ of one frame, and the frequency of each signal can be decreased to ¾ thereof, thus making it possible to contribute to reduced power consumption.

In addition, in FIG. 4, the brightness of the R, G and B light sources in the R, G and B fields are reduced to 75% thereof. This is because in this system, each lighting time period of R, G and B light sources is increased to ⅓ times as compared to that in FIGS. 2 and 3, and the emission intensity of light sources is decreased to ¾ times to equalize the level of brightness sensed by the observer. Thereby, it is possible to prevent the color sequential artifact while maintaining the same brightness as that in FIGS. 2 and 3, and reduce power consumption to ½ of that in FIG. 2.

Figure 5:
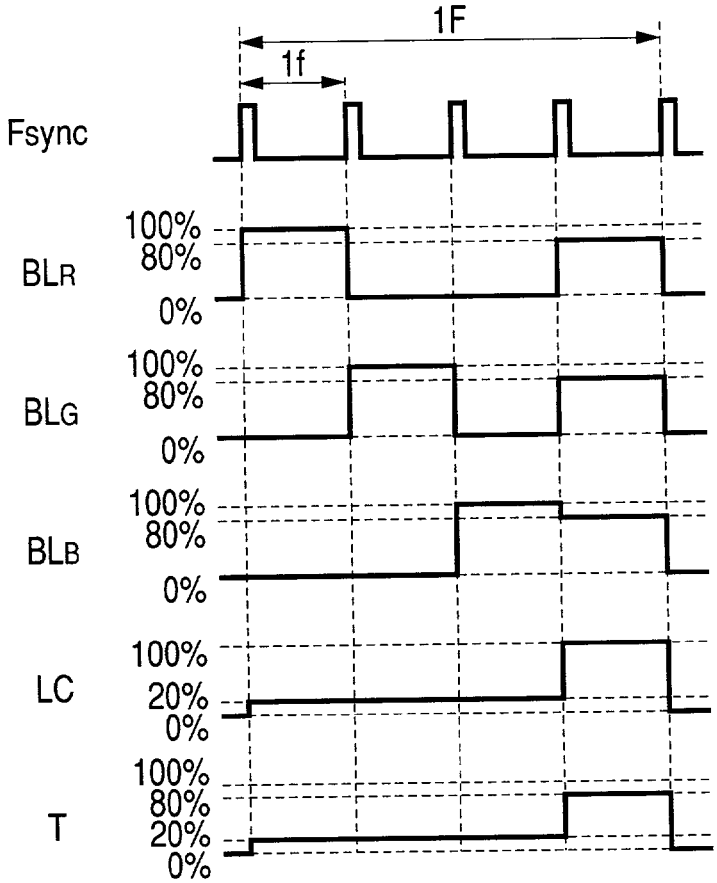
FIG. 5 is a timing chart when the minimum value of inputted R, G and B brightness signals is 100% and the above-described proportion is 80%.
Figure 6:
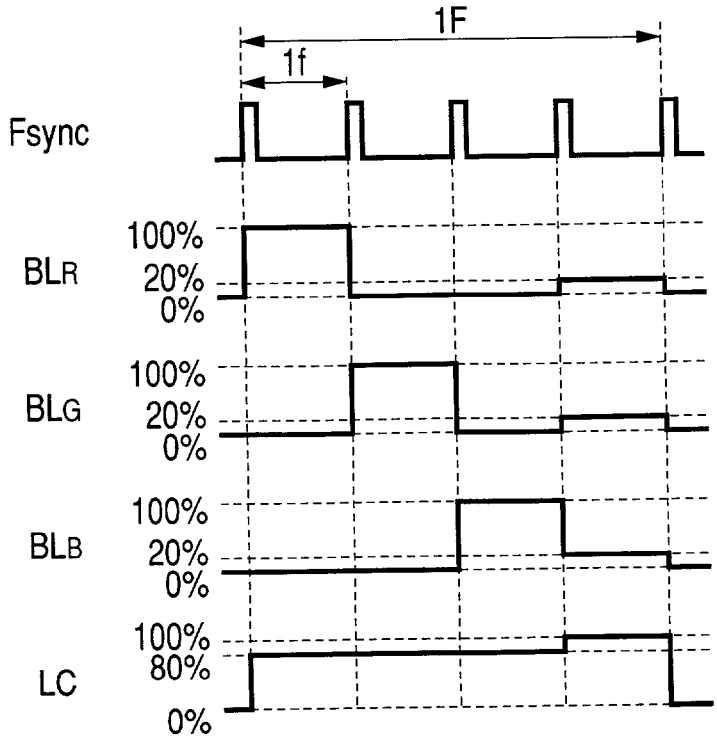
FIG. 6 is a timing chart when the minimum value of inputted R, G and B brightness signals is 100% and the above-described proportion is 20%.

In addition, FIGS. 5 and 6 are timing charts in the case where the proportion of the white color signal displayed in the W field is 80% (FIG. 5) and 20% (FIG. 6) when the signal in the brightest state is inputted, namely when the minimum value Wmin=the maximum value Wmax of the brightness levels of the R, G and B signals is a 100% gradation level.

In FIG. 5, each light source in the W field is lit at an emission intensity giving brightness of 80% with respect to the maximum value Wmax of white color information, and remaining 20% of white color information provides 20% of display information to the liquid crystal display part in R, G and B color fields.

In FIG. 6, each light source in the W field is lit at an emission intensity giving brightness of 20% to the maximum value Wmax of white color information, and remaining 80% of white color information provides 80% of display information to the liquid crystal display part in R, G and B color fields.

For each W field, a situation is shown in which each color light source is lit at an emission intensity according to the above-described proportion and Wmax, and in accordance therewith, predetermined display information is given to the liquid crystal display part.

Figure 7:
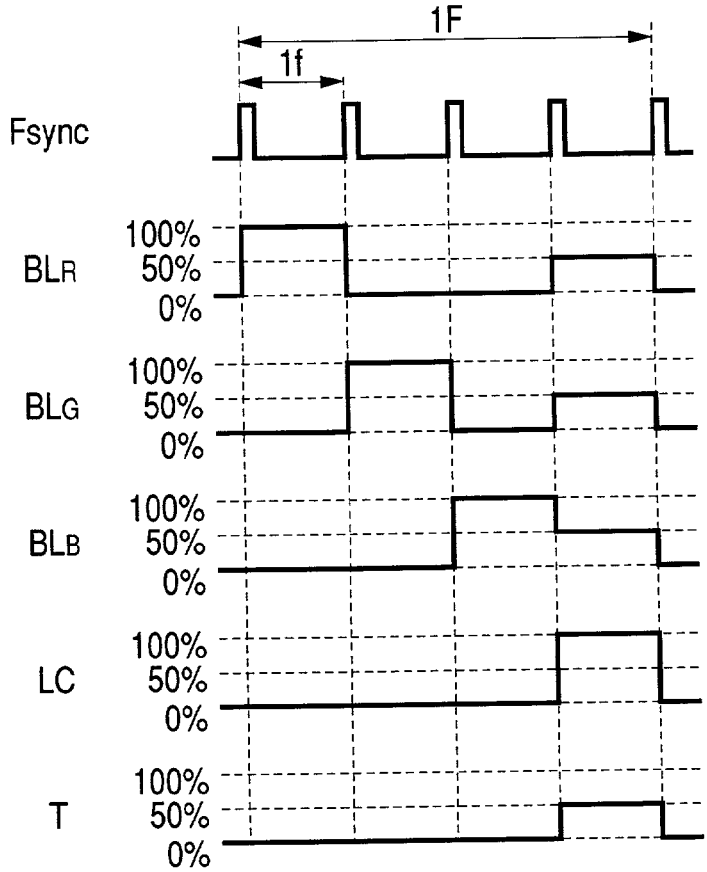
FIG. 7 is a timing chart when the minimum value of inputted R, G and B brightness signals is 50% and the above-described proportion is 10%.
Figure 8:
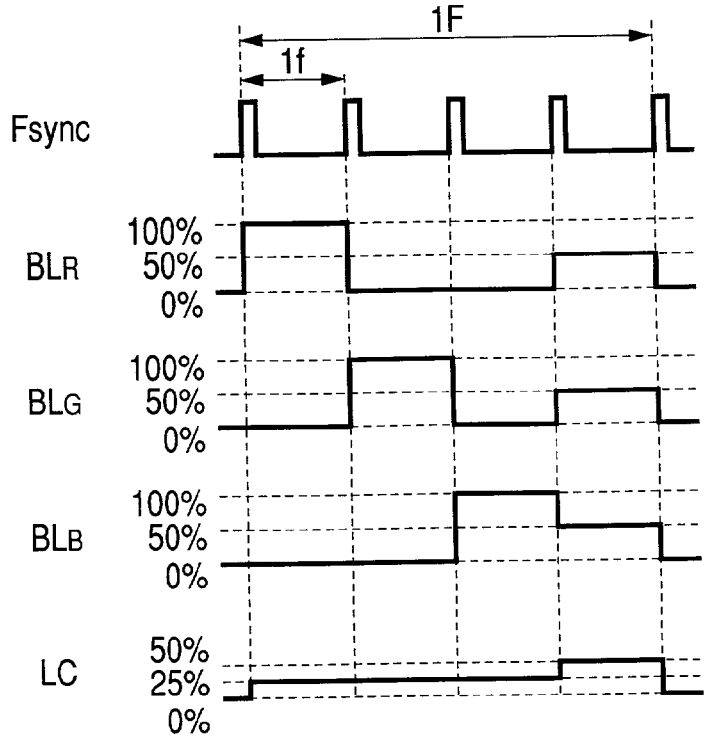
FIG. 8 is a timing chart when the minimum value of inputted R, G and B brightness signals is 50% and the above-described proportion is 50%.

Also, FIGS. 7 and 8 are timing charts in the case where the above-described proportion is 100% (FIG. 7) and 50% (FIG. 8) in the frame in which the Brightness level of inputted R, G and B signals is 50% at maximum (i.e., Wmax is 50%).

In FIG. 7, because the above-described proportion is 100%, 100% of display information is given to the liquid crystal display part with the emission intensity of the light source in the W field being 50%. A situation is shown in which display information given to the liquid crystal display part becomes 0% in the R, G and B fields, and white color information corresponding to Wmax 50% is obtained in the W field.

In FIG. 8, because the emission intensity of the light source in the W field is reduced to 50% thereof, and the above-described proportion is 50%, the transmittance of the liquid crystal display part is set at 50%. In addition, for obtaining transmittance equivalent to 25% amount subtracted in the W field, 25% of transmittance is given to the liquid crystal display part in the R, G and B fields, thus providing the same light intensity for the observers.

As described above, in the color liquid crystal display device in field sequential mode with the liquid crystal panel combined with the three primary color light source unit, when there exists a dynamic image of high brightness and achromatic color with a noticeable color sequence artifact, a W field can be displayed to provide RGBW four-field display to prevent the color sequential artifact, and power consumption of the light source can be reduced. Also, when a static image is displayed, the device can be used with horizontal/vertical frequencies decreased to those of three-fold-speed by adopting a R/G/B system, thus making it possible to further reduce power consumption.

Figure 9:
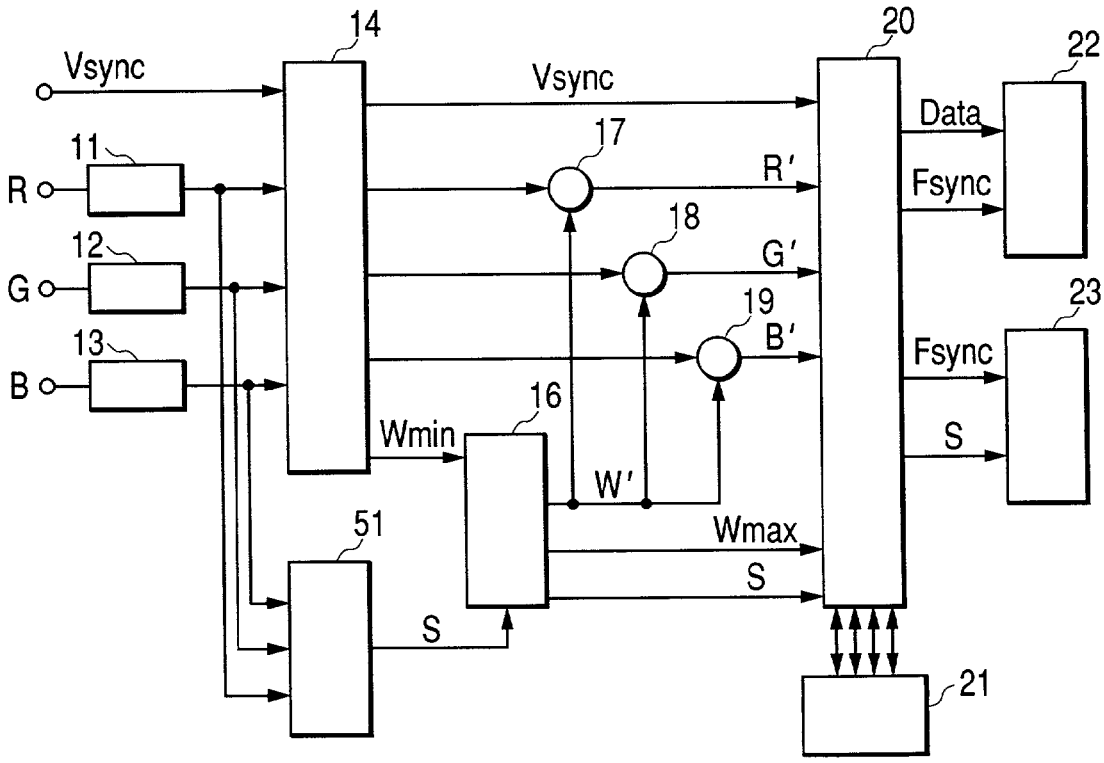
FIG. 9 is a block diagram of a color liquid crystal display device different in constitution of means for setting the proportion from that shown in FIG. 1.

In the above-described embodiment, the dynamic image/brightness detection circuit is used as means for setting the above-described proportion, but a proportion modulation switch 51 may be provided to make an adjustment as shown in FIG. 9. Specifically, for example, three levels may be set such that the level at which the above-described proportion equals 100% corresponds to a color sequential artifact prevention mode, the level at which it equals 50% corresponds to a color sequential power saving mode, and the level at which it equals 0% corresponds to a power saving mode, allowing a user to switch the modes when the device is used.

Figure 10:
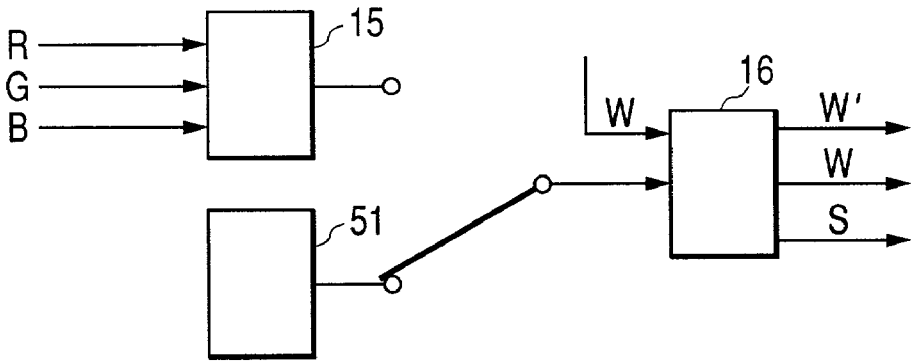
FIG. 10 shows an example of another constitution of means for setting the proportion.
Figure 11:
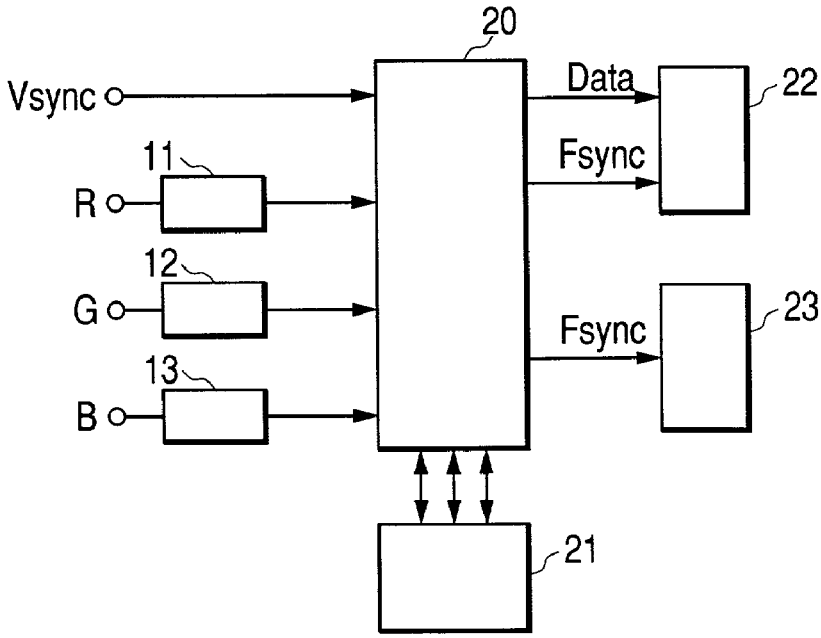
FIG. 11 is a block diagram of a liquid crystal display device of a conventional example 1 performing color display based on a RGB three-color system.
Figure 12A:
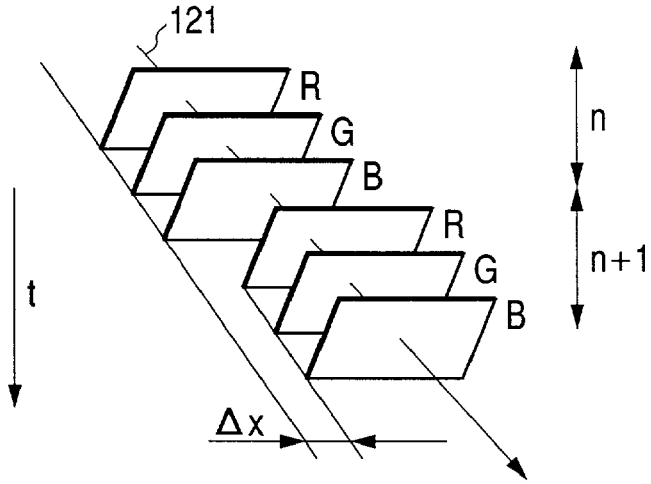
FIGS. 12A and 12B are diagrams illustrating a color sequential artifact occurring in the device of FIG. 11.
Figure 12B:
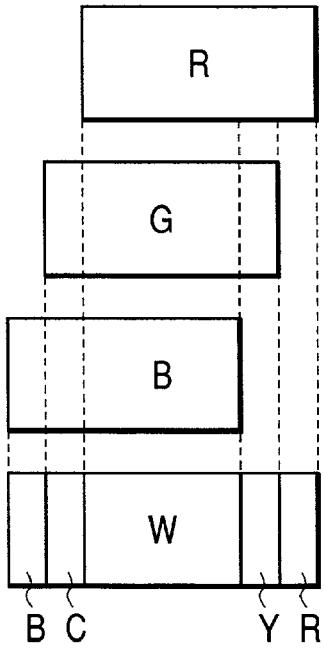
Figure 13:
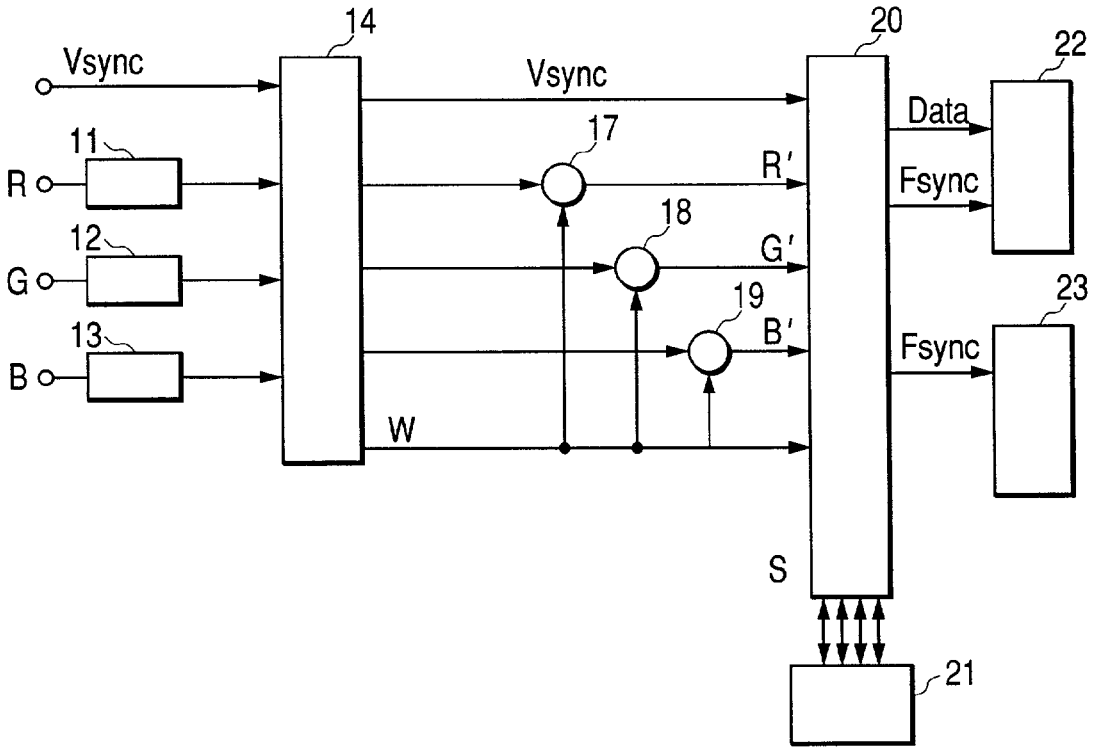
FIG. 13 is a block diagram of a liquid crystal display device of a conventional example 2 performing color display based on a RGBW four-color system.
Figure 14A:
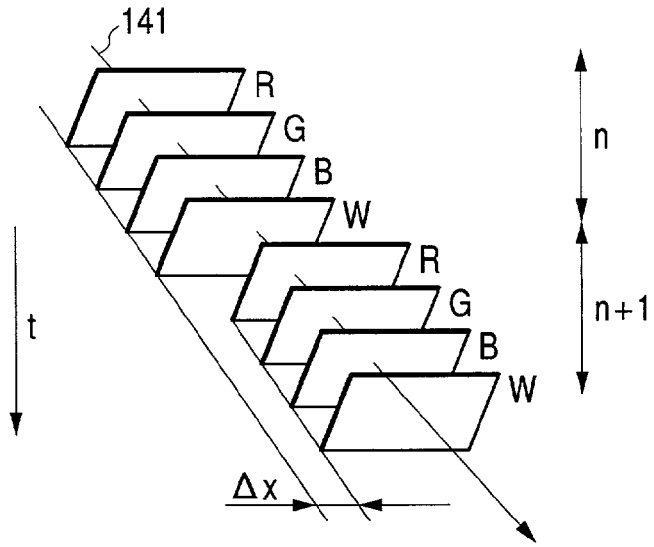
FIGS. 14A and 14B are diagrams illustrating a mechanism in which a color sequential artifact is restrained in the device of FIG. 13.
Figure 14B:
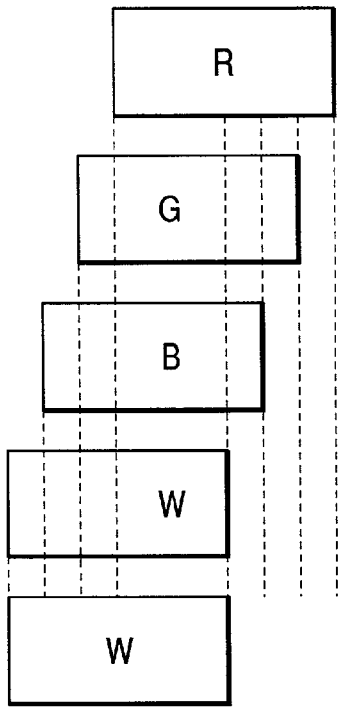
Figure 15:
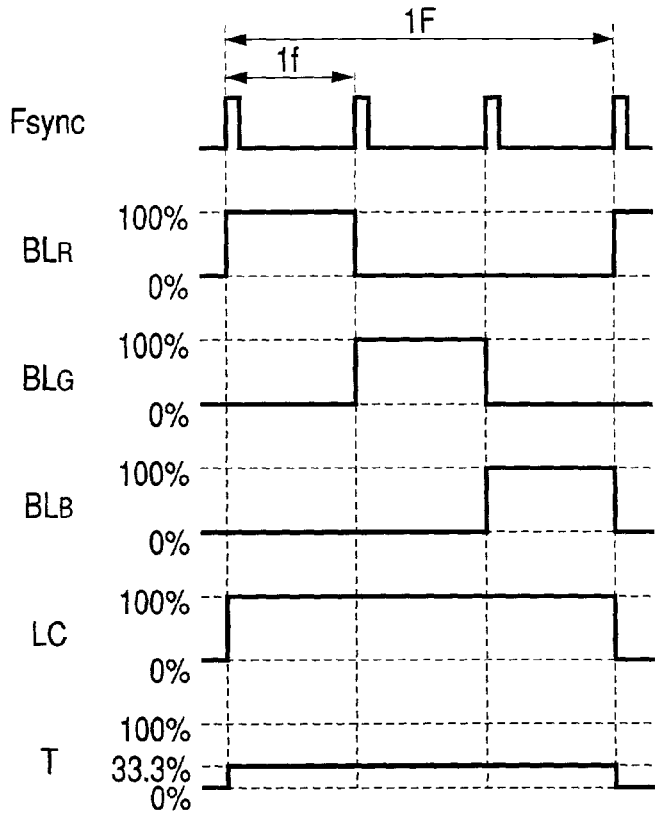
FIG. 15 is a timing chart showing the lighting timing of each of R, G and B light sources and the light transmittance of the liquid display part when white display is performed, in the liquid crystal device of FIG. 11.
Figure 16:
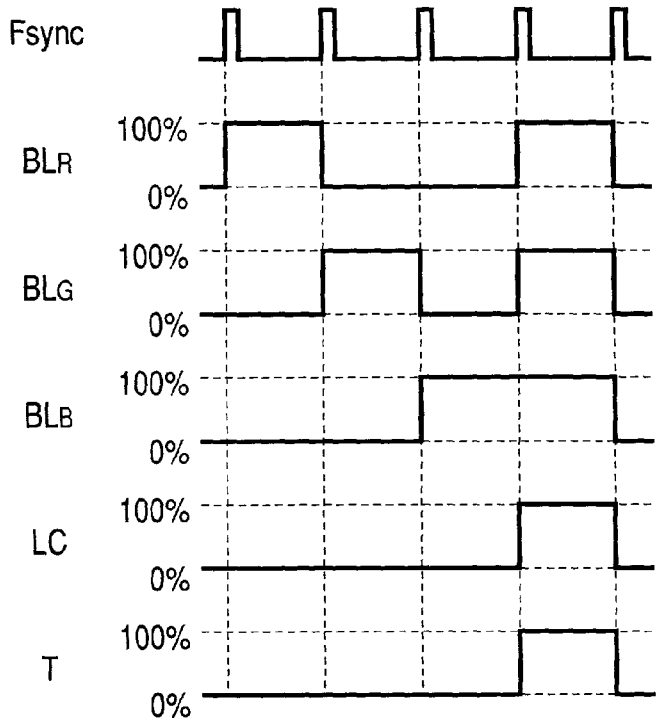
FIG. 16 is a timing chart showing the lighting timing of each of R, G and B light sources and the light transmittance of the liquid display part when white display is performed, in the liquid crystal device of FIG. 13.

In addition, as shown in FIG. 10, it is also possible to provide both the automatic mode in FIG. 1 in which the above-described proportion is set by the dynamic image/brightness detection circuit 15 and the manual mode in FIG. 9 in which the proportion is set by the proportion modulation switch 51, and allow the modes to be selected using a selector switch or the like.

As described above, in the liquid crystal display device of the present invention, the proportion of the W signal to be displayed in the W field is set corresponding to the level of the dynamic image, and display is performed based on the RGBW system, thus preventing the color sequential artifact.

In addition, by controlling the illumination intensity of the light source in the W field at low level in accordance with a set proportion, power consumption of the light source can be reduced. Also, in the case where the sampling rate is 0%, the W field is omitted to perform display based on the RGB three-field system, and the light source is lit at illumination brightness lower than the brightness for the RGBW four field frame, thereby making it possible to further reduce power consumption of the display device.

What is claimed is:

1. A color liquid crystal display device comprising:

a liquid crystal display part;

light sources for irradiating the liquid crystal display part with lights of three primary colors sequentially or simultaneously, the device displaying a frame picture by sequential fields of three primary color pictures and a field of a white picture in the liquid crystal display part;

a circuit for determining a minimum level of brightness among three color signals in a pixel;

a circuit for subtracting the minimum level from the level of brightness of the three primary color signals to create display signals for respective primary color fields;

a circuit for determining a maximum among minimum levels of brightness of all pixels in a frame and multiplying the minimum levels of each pixel by a constant to create a display signal in the white field, the constant being determined by the maximum and a weight factor of the white field relative to the primary color fields; and a circuit for modulating the brightness of primary color light sources in the white field according to the constant, wherein the constant is automatically set depending on changes of displayed information.

2. The color liquid crystal display device according to claim 1, wherein in a frame with the constant equal to 0%, one frame is divided into three fields to perform display only by three-color fields.

3. The color liquid crystal display device according to claim 1, wherein the constant is in the range of 0% to 100%.

4. The color liquid crystal display device according to claim 1, wherein the brightness of the light source in respective primary color fields is reduced depending on the brightness in the white field.

* * * * *

UNITED STATES PATENT AND TRADEMARK OFFICE

CERTIFICATE OF CORRECTION

PATENT NO. : 6,961,038 B2 
APPLICATION NO. : 09/994746
DATED : November 1, 2005
INVENTOR(S) : Hideki Yoshinaga et al.

It is certified that error appears in the above-identified patent and that said Letters Patent is hereby corrected as shown below:

IN THE DRAWINGS
Figs 11-16 have been Labelled as -- PRIOR ART --.

COLUMN 1
Line 33, "AID" should read --A/D--.

COLUMN 2
Line 15, "eye." should read --eye. (New paragraph)
--Disadvantages of display regarding this conventional example 1 will be described below.--.

COLUMN 3
Line 9, "subjected" should read --subjected to--.

COLUMN 6
Line 54, "10%;" should read --100%;--.

COLUMN 10
Line 10, "in" should read --In--.

COLUMN 12
Line 17, "four" should read --four- --.

Signed and Sealed this

Fifteenth Day of August, 2006

JON W. DUDAS
*Director of the United States Patent and Trademark Office*